United States Patent [19]

Yagasaki et al.

[11] Patent Number: 4,669,862

[45] Date of Patent: Jun. 2, 1987

[54] PROGRAM CONTROLLED IMAGE FORMING APPARATUS

[75] Inventors: Toshiaki Yagasaki, Hino; Shunichi Masuda; Yukio Sato, both of Tokyo, all of Japan

[73] Assignee: Canon Kabushiki Kaisha, Tokyo, Japan

[21] Appl. No.: 713,382

[22] Filed: Mar. 18, 1985

Related U.S. Application Data

[63] Continuation of Ser. No. 424,343, Sep. 27, 1982.

[30] Foreign Application Priority Data

Sep. 29, 1981 [JP] Japan ..... 56-154683
Sep. 29, 1981 [JP] Japan ..... 56-154684
Sep. 29, 1981 [JP] Japan ..... 56-154685

[51] Int. Cl.[4] ..... G03G 15/00

[52] U.S. Cl. ..... 355/14 R; 355/3 R; 355/14 C

[58] Field of Search ..... 355/14 R, 14 C, 3 R; 235/103

[56] References Cited

U.S. PATENT DOCUMENTS

| | | | |
|---|---|---|---|
| 4,072,415 | 2/1978 | Inoue et al. | 355/14 R |
| 4,162,396 | 7/1979 | Howard et al. | 355/14 C X |
| 4,203,663 | 5/1980 | Ogura et al. | 355/14 C |
| 4,206,995 | 6/1980 | Legg | 355/14 C |
| 4,270,860 | 6/1981 | Tsuda et al. | 355/14 R |
| 4,280,763 | 7/1981 | Arai et al. | 355/14 R |
| 4,322,847 | 3/1982 | Dodge et al. | 355/14 C X |

*Primary Examiner*—A. C. Prescott
*Attorney, Agent, or Firm*—Fitzpatrick, Cella, Harper & Scinto

[57] ABSTRACT

An image forming apparatus comprises a rotating drum, a plurality of processing means including means for charging and discharging the rotating drum, a pulse generator for controlling timing of at least one of the processing means and means for starting the charging and discharging means after having checked a normal condition of the rotating drum when a start of image formation instruction has been issued.

12 Claims, 16 Drawing Figures

PROGRAM CONTROLLED IMAGE FORMING APPARATUS

This is a continuation of application Ser. No. 424,343, filed Sept. 27, 1982, now abandoned.

BACKGROUND OF THE INVENTION

1. Field of the Invention

The present invention relates to a diagnosis unit for a copying apparatus or a printing apparatus.

2. Description of the Prior Art

In a prior art copying apparatus which carries out corona charging, exposure, development, corona transfer and residual image removal while a photosensitive drum is rotating, a corona charger and a discharger are turned on simultaneously with the start of rotation of the photosensitive drum.

In such an apparatus, if the photosensitive drum does not rotate in spite of a start of copy instruction by some reason, a local ununiform charge which is hard to remove is applied to the photosensitive drum by a high voltage of the corona charger activated by the instruction and the photosensitive drum may be deteriorated thereby.

In another prior art copying apparatus, a lamp is lit simultaneously with or immediately after document scan. In such an apparatus, if the document scan does not start in spite of a copy instruction, a document platen glass is heated by the lamp lit by the instruction and the document platen glass may be broken.

In other prior art copying apparatus which carries out latent image formation, development, transfer, residual image removal and jam detection while the photosensitive drum is rotating, a series of pulses are generated as the photosensitive drum is rotated and the pulses are counted to control various timings.

In such an apparatus, if the pulses are abnormal, timing error is produced and this error is detected to cut off a power supply of the apparatus.

However, if the power supply is cut off non-disriminately, a toner image may remain on the photosensitive drum, a high potential charge may remain or a transfer paper being separated may remain. As a result, various inconveniences are encountered in a first cycle after resumption of copying operation.

In the copying apparatus, when an image exposing lamp fails, no image is formed on a transfer paper and a sheet ejected has a solid black image thereon. If an operator continues copying operation in a multi-copy mode without noticing the failure, developer is wasted and a cleaner and a fixer are overloaded. In order to prevent such inconveniences, means for detecting the break of the lamp is provided so that the copying operation is immediately stopped when the break is detected.

However, the transfer paper remains unfed in the apparatus and it jams when the copying operation is resumed.

To avoid such a problem, it has been proposed not to stop the paper feed upon detection of the break of the lamp but to stop the feed of subsequent papers to prevent continuous paper feed.

In this case, however, the fed transfer paper has a solid black image thereon and the cleaner and the fixer are overloaded.

SUMMARY OF THE INVENTION

It is an object of the present invention to provide a copying/printing apparatus which is free from the above defects.

It is another object of the present invention to provide an image forming apparatus which starts operation of processing means such as a corona charger only after movement of a movable body has been confirmed.

It is other object of the present invention to provide an image forming apparatus allows image reproducion of a high quality of first sheet.

It is a further object of the present invention to provide an image forming apparatus which prevents troubles of the apparatus as much as possible.

It is a further object of the present invention to provide an image forming apparatus which continues the operation of the apparatus as long as possible when the apparatus troubles.

It is a still further object of the present invention to provide an image forming apparatus which continues the operation of the apparatus by alternative means when the apparatus troubles.

In accordance with one feature of the present invention, when an abnormal condition of pulses is detccted, the operation of a portion of the apparatus is stopped but a rotating drum is not immediately stopped but stopped after flat cleaning, flat potential unification and ejection of transfer paper have been completed.

In accordance with another feature of the present invention, when the abnormal condition of pulses is detected during counting of pulses for controlling the operation of the apparatus, a separate timer is activated to carry out the operation control. Accordingly, post-rotation can be completed if an abnormal condition of pulses occurs in the post-rotation.

In accordance with other feature of the present invention, when the pulse is generated as the rotating drum rotates, an abnormal condition of a pulse generating element and an abnormal condition of the rotating drum are discriminated, and compensation control is carried out only when the former is abnormal.

In accordance with a further feature of the present invention, when an image exposing lamp is broken, uncomfortable feeling is not imparted to an operator, loss of the copying apparatus is minimized and processing unit is not overloaded.

In accordance with a still further object of the present invention, when the image exposing lamp fails, a blank exposing lamp is lit and a stop sequence is carried out while developer, a cleaner and a fixer are being protected. A cause of stop of the sequence or white image is informed to the operator and an alarm is indicated.

In accordance with a further feature of the present invention, when the image exposing lamp is to be lit in a very near feature in a sequence or the image exposing lamp already lit suddenly turns off, the blank exposing lamp or all of black suppression lamps in the direction of drum width if the blank exposing lamp is not operative are immediately lit to prevent solid black image on an ejected sheet and carry out a stop sequence.

In accordance with a still further feature of the present invention, when the blank exposing lamp fails, the image exposing lamp or all of the black suppression lamps are lit to enhance discharge effect.

BRIEF DESCRIPTION OF THE DRAWINGS

FIGS. 8-1 to 8-4 show operational time charts of the circuit of FIG. 7.

DESCRIPTION OF THE PREFERRED EMBODIMENTS

Figure 1:
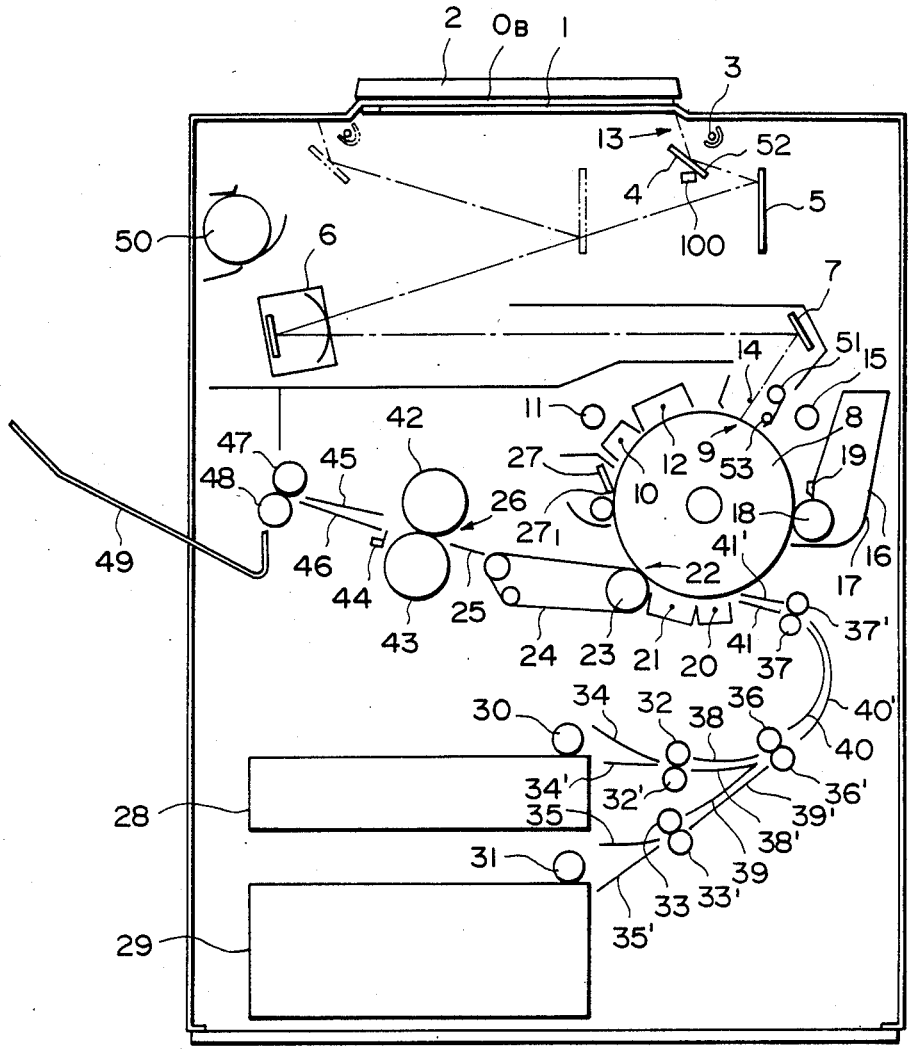
FIG. 1 shows a sectional view of a copying apparatus to which the present invention is applicable.

Referring to FIG. 1, an embodiment of a copying apparatus of the present invention is explained.

It is an electrophotographic copying machine of a powdered developer transfer system. Numeral 1 denotes an original mount table on which an edge of an original $O_B$ to be copied is mounted to align to a reference position of the original mount table 1 and the original $O_B$ is held by an original cover 2. Arranged below the original mount table 1 are an original illumination lamp 3, movable mirrors 4 and 5, a stationary in-mirror lens 6, a mirror 7 and a photosensitive drum 8, at solid line positions shown in FIG. 1. A fan 50 is arranged to cool the original mounted table 1 which is heated by the original illumination lamp 3.

When a copy key, not shown, is depressed, the photosensitive drum 8 starts to rotate clockwise as viewed in FIG. 1 and chargers and lamps to be described later are activated, and the original illumination lamp 3 and the movable mirrors 4 and 5 of the movable portion of the optical system are moved to broken line positions shown in FIG. 1. When the photosensitive drum 8 completes a predetermined rotation, a start of exposure signal is issued and the original illumination lamp 3 and the first mirror 4 start to move rightward from the broken line positions at the same velocity as a peripheral velocity of the photosensitive drum 8, and the second mirror 5 starts to move rightward from the broken line position at one half velocity of the peripheral velocity of the photosensitive drum 8. An image of the original $O_B$ which is illuminated by the original illumination lamp 3 is focused onto the photosensitive drum 8 at an exposing station 9 by the optical system including the movable mirrors 4 and 5, the in-mirror lens 6 and the mirror 7. After the exposure, the original illumination lamp 3 is turned off and the lamp 3 and the movable mirrors 4 and 5 stop their rightward movements and are immediately returned reversely or leftward. A return point is determined by a signal which represents a paper size. The above operation is repeated by the number of times corresponding to the number of copies preset by a key, not shown. After the exposure for the present number of copies, the original illumination lamp 3 and the movable mirrors 4 and 5 are returned to the predetermined solid line positions and stop there. The leftward movement velocity is faster than the rightward movement velocity to enhance a copying efficiency. Numeral 51 denotes a blank lamp which is turned on when the lamp 3 is turned on and turned off when the lamp 3 is turned on so that carrying out of toner under non-exposure condition is minimized.

The photosensitive drum 8 has a photosensitive layer covered with a transparent insulative layer and it is rotated clockwise as described above. The photosensitive drum 8 is first AC-discharged by a pre-AC discharger which is applied with an AC high voltage from a high voltage power supply, not shown, and exposed by a lamp 11 so that charges on the insulative layer and in the photosensitive layer are discharged. Then, the photosensitive drum 8 is charged positively (+) by a primary charger 12 which is applied with a positive (+) high voltage from a high voltage power supply, not shown. When the photosensitive drum 8 reaches an exposing station 9, an image from an illumination station 13 is slit-exposed and AC-discharged by an AC discharger 14 which is supplied with an AC high voltage from a high voltage power supply, not shown. Then, the photosensitive drum 8 is flat-exposed by a lamp 15 to form an electrostatic latent image thereon, and then the photosensitive drum 8 goes to a developer 16. The developer 16 includes a container 17 for containing developing agent, a developing roll 18 and a doctor blade 19. The electrostatic latent image on the photosensitive drum 8 is developed by the developing agent magnetically attracted to the developing roll 18. Then, a transfer paper P fed from a paper feed station is contacted to the photosensitive drum 8 and charged by a transfer charger 20 which is applied with a high positive (+) voltage from a high voltage power supply, not shown, so that the image on the photosensitive drum 8 is transferred to the transfer paper P. After the transfer, the transfer paper P is discharged by a separation discharger 21 which is applied with an AC high voltage from a high voltage power supply so that an attraction force to the photosensitive drum 8 is weakened. The transfer paper P is then pulled by a roll 23 at a station 22 to be separated from the photosensitive drum 8 and guided to a fixing station 26 by a belt 24 and a guide 25. The photosensitive drum 8 has its residual developing agent wiped off by an edge $27_1$ of a press-contacted blade cleaner 27 and repeates the next cycle again. After the cycle has been repeated by the number of times corresponding to the preset number of copies, the photosensitive drum 8 further continues to rotate so that the charges in the photosensitive layer are discharged by the AC discharger 14 and the flat exposure by the lamp 15, and then it is rotated by a predetermined amount to be ready for the next operation.

Figure 9:
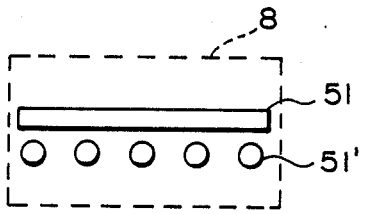
FIG. 9 shows a plan view of a blank lamp and associated elements.

As shown in FIG. 9, black suppression lamps 51' are arranged separately from or in place of the elongated blank lamp 51 which extends in the direction of drum width and they are selectively turned on throughout the image exposure and image non-exposure operations in accordance with a copy size and a copy magnification in order to prevent toner from being deposited on a non-image area in the direction of drum width.

Figure 2:
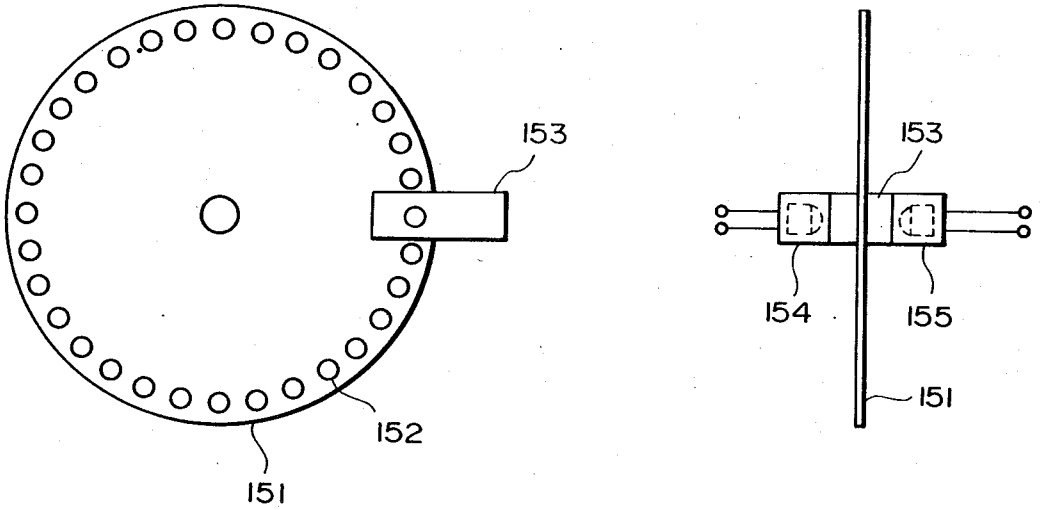
FIG. 2 shows a plan view of detecting means for detecting a status of a rotating drum.

FIG. 2 shows sectional and plan view of a disc 151 which is rotated at a several times speed of the drum speed to generate a sequence of clock pulses for forming control pulses. The disc 151 has apertures 152. Numeral 153 denotes a photo-interrupter having a light emitting diode 154 and a photosensitive device 155 opposing to the aperture 152. As the drum rotates, the photosensitive device 155 generates a sequence of pulses DP. The disc 151 may be mounted on a motor which drives the mirrors of the optical system.

Figure 3:
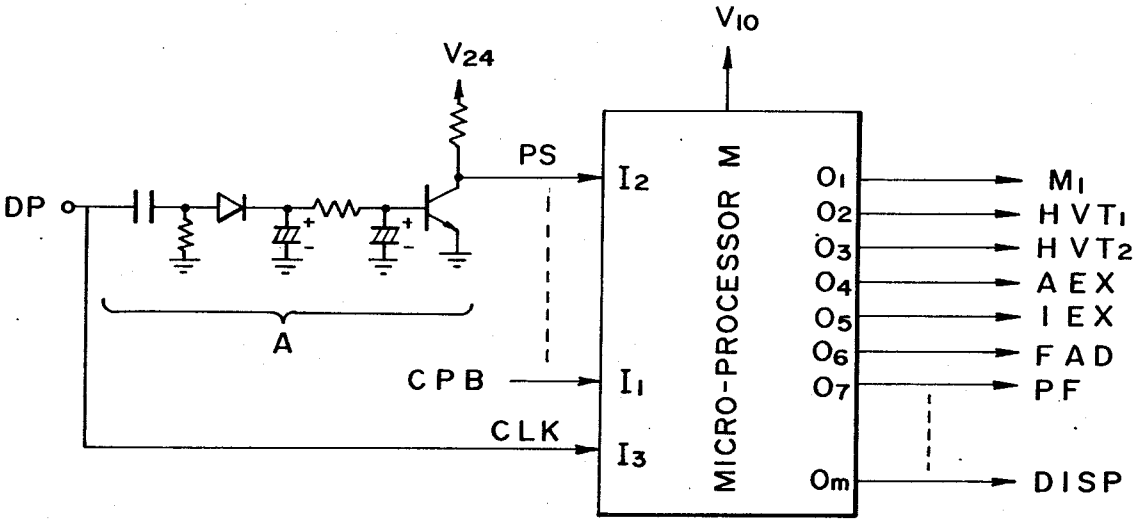
FIG. 3 shows a control circuit of the present invention, FIG. 4 composed of FIGS. 4A and 4B show a control flow chart of the circuit of FIG. 3.

FIG. 3 shows a circuit which determines a rotating status of the drum and controls sequences of the processes. M denotes a microprocessor which may be a well known one-chip microprocessor such as μPD 545 or 546 and has a program memory ROM which contains a program shown by a flow of FIG. 4 to carry out the determination and the control. A denotes a circuit which produces an output "0" when the pulse DP is repeatedly applied thereto and produces an output "1" otherwise, CPB denotes a signal from a copy button, not shown, $V_{10}$ and $V_{24}$ denote drive power supplies, $M_1$ denotes a drive signal for a main motor which rotates the drum, $HVT_1$ denotes a signal to apply the high voltage to the precharger 10, the primary charger and the transfer charger 20, $HVT_2$ denotes a signal to apply the high voltage to the separation charger 21, AEX denotes a signal to turn on the pre-lamp 11 and thc flat lamp 15, IEX denotes a signal to turn on the halogen lamp 3, FAD denotes a signal to start the scan, PF denotes a signal to start the paper feed from a cassette, and DISP denotes a signal to display and alarm an abnormal condition. Those are connected to the microcomputer M.

Figures 4, 4A:
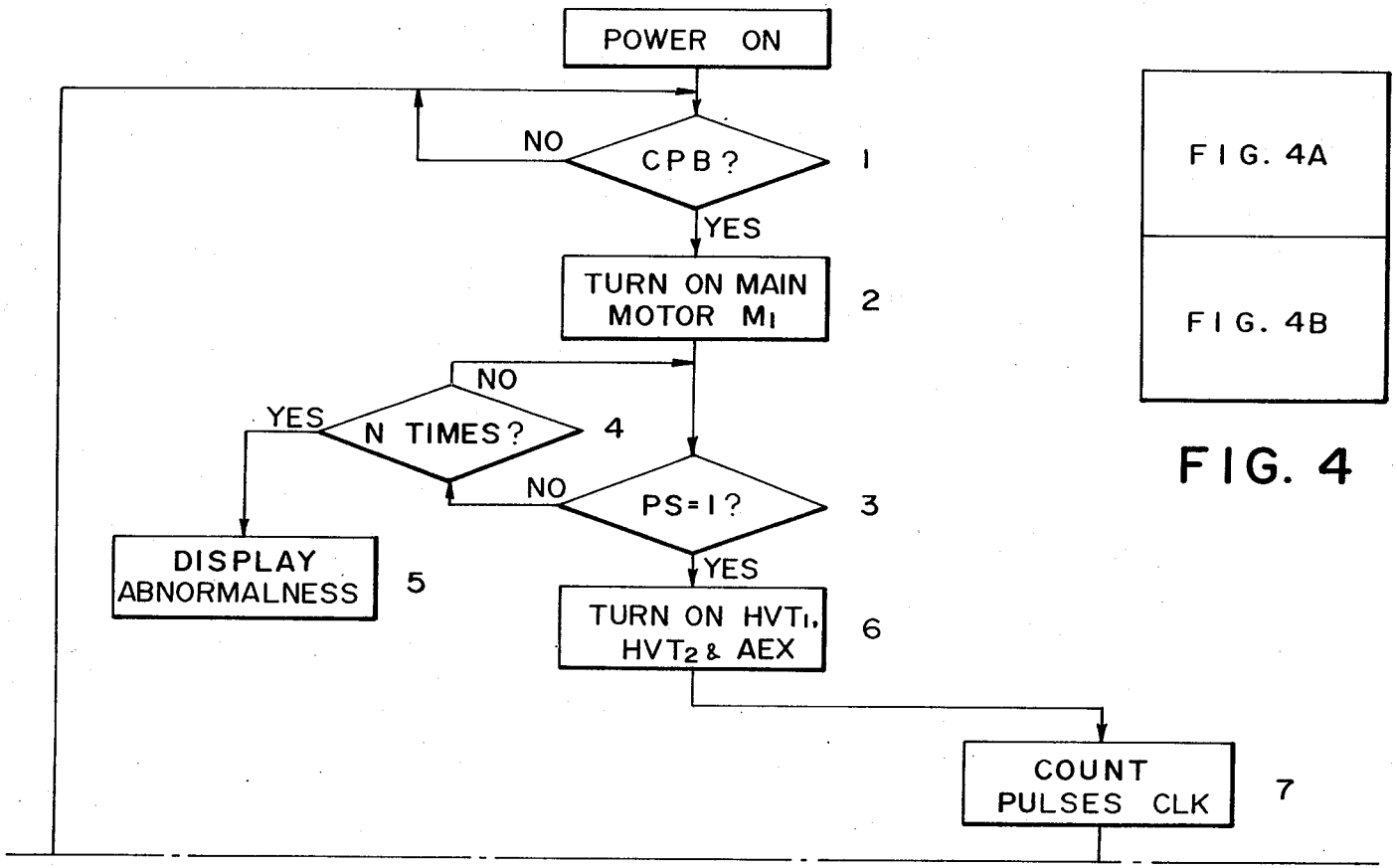
Figure 4B:
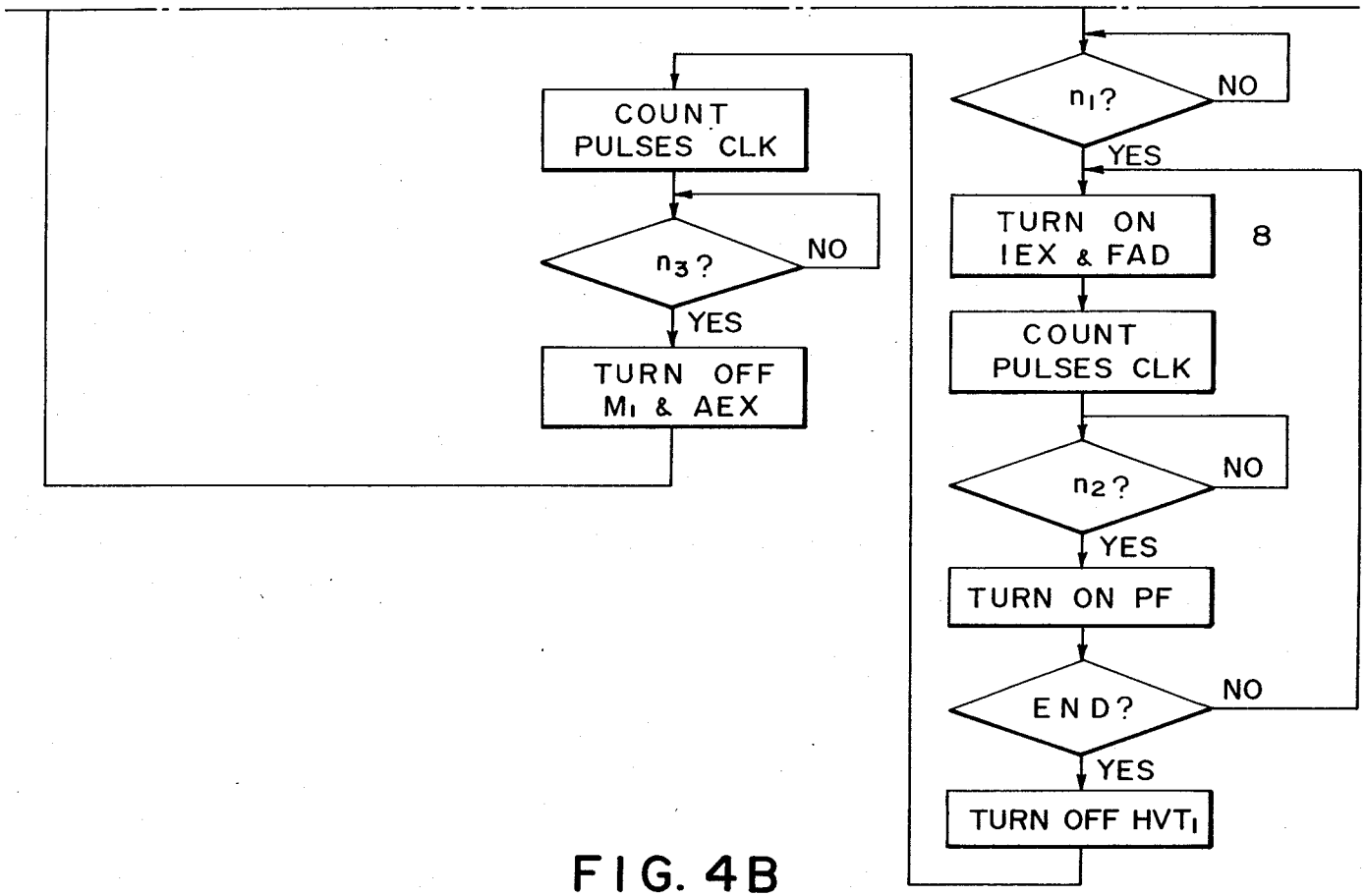

Referring to FIG. 4, when a power switch, not shown, is turned on, the microprocessor M starts the programmed operation. First, it checks the copy button signal CPB at an input port $I_1$ (step 1). If the signal CPB is present, the microprocessor M turns on the main motor (step 2). Then, the microprocessor M checks if the pulse status signal PS at an input port $I_2$ is "1" or "0" (step 3). If it is "1" after N times trial of the decision routine (step 4), that is, if the pulse is not generated, the microprocessor M produces a signal DISP to indicate an abnormal condition of the drum and cuts off the power supplies $V_{10}$ and $V_{24}$ (step 5). The routine time for the N times of trial is longer than a period of the pulse DP, that is, it is several to ten times as long as the period of the pulse DP. More than 30 pulses DP are generated in one revolution of the drum. If a predetermined number of pulses DP are supplied to the circuit A before the routine of N times trial is completed, the circuit A produces the output "0". The microprocessor M responses to it to produce the signals $HVT_1$, $HVT_2$ and AEX to activate the charger and the lamp (step 6). In this manner, only after the normal condition of the drum has been confirmed, the charging is effected. Accordingly, a safe operation is assured.

The microprocessor M starts to count the pulses DP from the input port $I_3$ until a count reaches $n_1$. The image exposure is not started but delayed until the counting is completed. During this period, the drum is cleaned and it is prepared for a sensitivity adjustment and a potential stabilization. When the count reaches $n_1$, the microprocessor M produces the signals IEX and FAD and enters to a latent image step (step 8). When $n_2$ pulses CLK have been counted, the microprocessor M produces the signal PF to feed the paper. After the transfer, it checks if a preset number of copies have been made, and if not, it repeats the latent image formation. If the preset number of copies have been made, the microprocessor M first turns off the signal $HVT_1$ and then turns off the signal $HVT_2$ slightly later. Then, it counts the pulses CLK by count $n_3$ and then turns off the signal $M_1$ and AEX to stop the entire sequence. When the copy button is depressed again, it resumes the same routine.

In this manner, in accordance with the present embodiment, the sequence is started after the rotation of the drum has been confirmed. Therefore, a low cost and highly safe copying apparatus is provided.

When the halogen lamp is turned on simultaneously with or following to the start of the forward movement of the mirror of the optical system, the lamp is turned on after the movement of the optical system has been confirmed. Accordingly, the heating of the document platen glass by the lamp is prevented. This confirmation may be made by checking if a home switch 100 is turned on after a predetermined time period. The home switch serves to stop the backward movement after the scan.

When the drum is rotated and the charger is activated upon turn on of the main switch, the same concept is applicable.

Another embodiment of the present invention is explained below.

Figure 5:
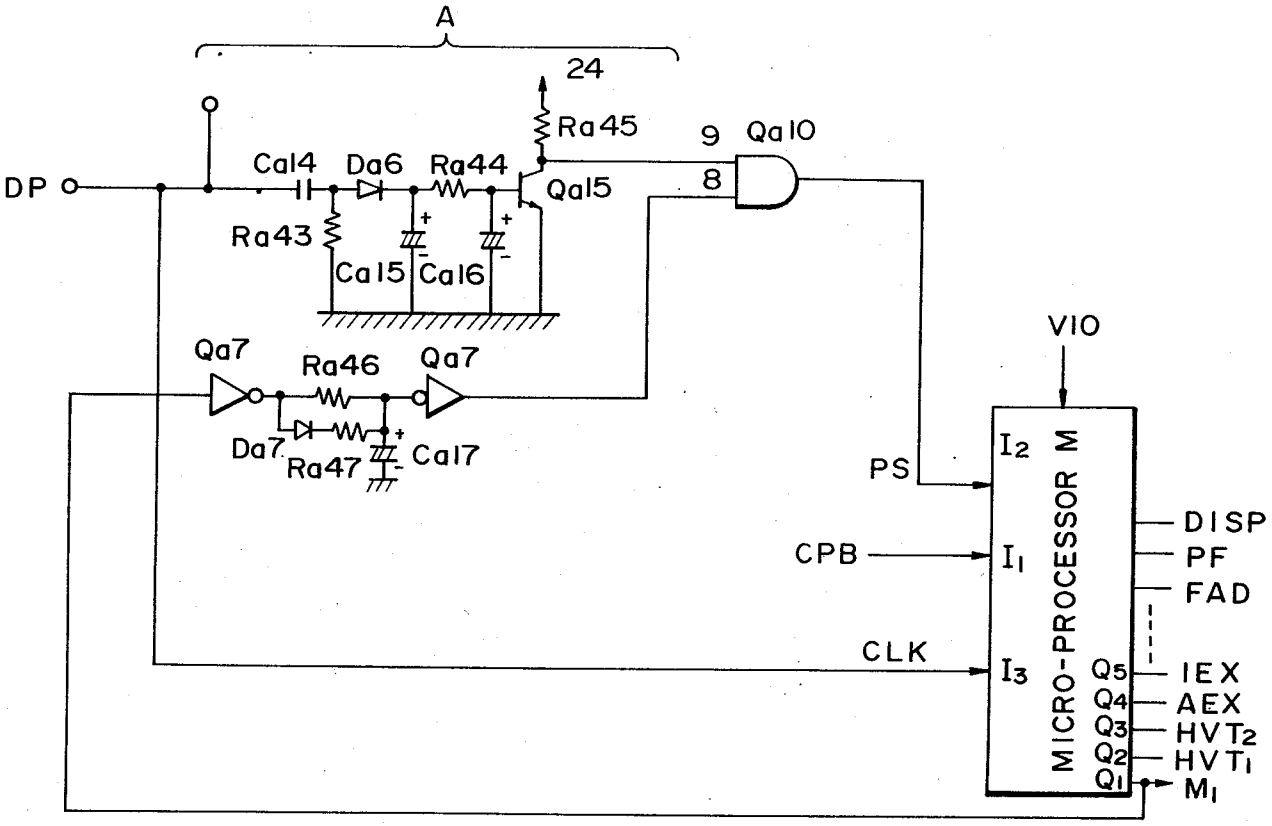
FIG. 5 shows another control circuit of the present invention, FIG. 6 composed of FIGS. 6A and 6B show a control flow of the circuit of FIG. 5.

FIG. 5 shows a circuit which checks a pulse status and controls sequences of the processes. M denotes a microprocessor which may be a well known one-chip microcomputer such as μPD 545 or 546 and has a program ROM which contains a program shown in a flow of FIG. 6 to carry out the checking of the pulse status and the control of the processes. CPB denotes a signal from a copy button, not shown, $V_{10}$ and $V_{24}$ denote drive power supplies, $M_1$ denotes a drive signal for a main motor which rotates the drum, $HVT_1$ denotes a signal to apply the high voltage to the pre-charger 10, the primary charger 12 and the transfer charger 20, $HVT_2$ denotes a signal to apply the high voltage to the secondary charger 14 and the separation charger 21, AEX denotes a signal to turn on the pre-lamp 11 and the flat lamp 15, IEX denotes a signal to turn on the halogen lamp 3, FAD denotes a signal to start the scan, PF denotes a signal to start the paper feed from the cassette, and DISP denotes a signal to display and alarm an abnormal condition. These are connected to the microprocessor M. An input circuit A to the microprocessor M checks the status of the pulse DP and has a filter comprising Ca 15, Ca 16 and Ra 44. The pulse DP may be generated by a separate oscillator from the disc which oscillates at a frequency of approximately 5 KHz. In this case, the main motor is constructed by a synchronous motor such as a pulse motor so that it is driven by the pulse DP.

When the pulse DP is generated at such a frequency, a transistor Qa 15 is turned on. As a result, an input terminal 9 of a gate Qa 10 is "0". On the other hand, when the main motor drive signal $M_1$ is "1", an input terminal 8 of the gate Qa 10 is "1". Accordingly, an output PS of the gate Qa 10 is "0". However, if the clock pulse DP ceases to generate during the drive of the motor, the transistor Qa 15 is turned off and the output PS of the gate Qa 10 assumes "1". This "1" signal is applied to an input port $I_2$ of the microprocessor M as an abnormal condition input signal.

Figures 6, 6A:
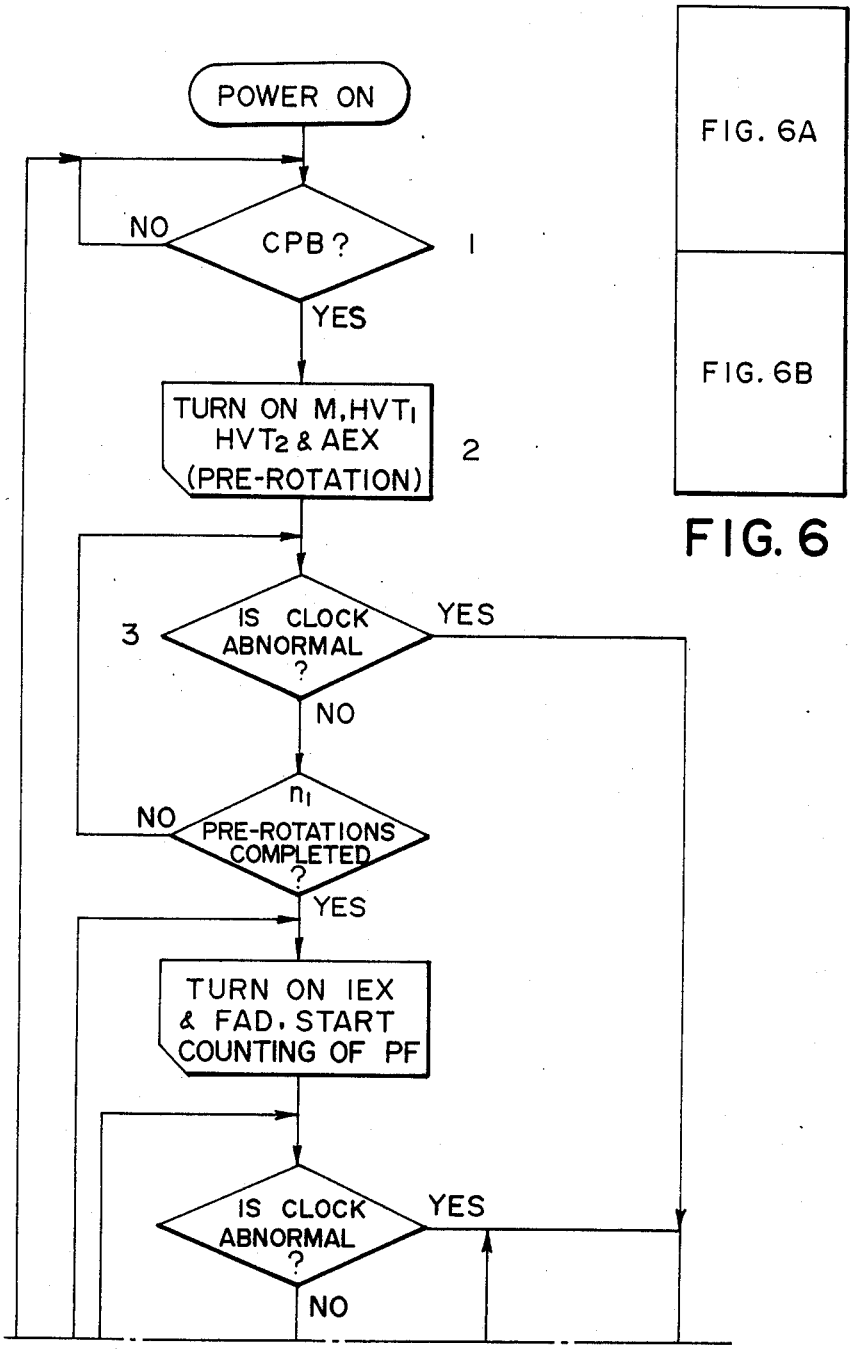
Figure 6B:
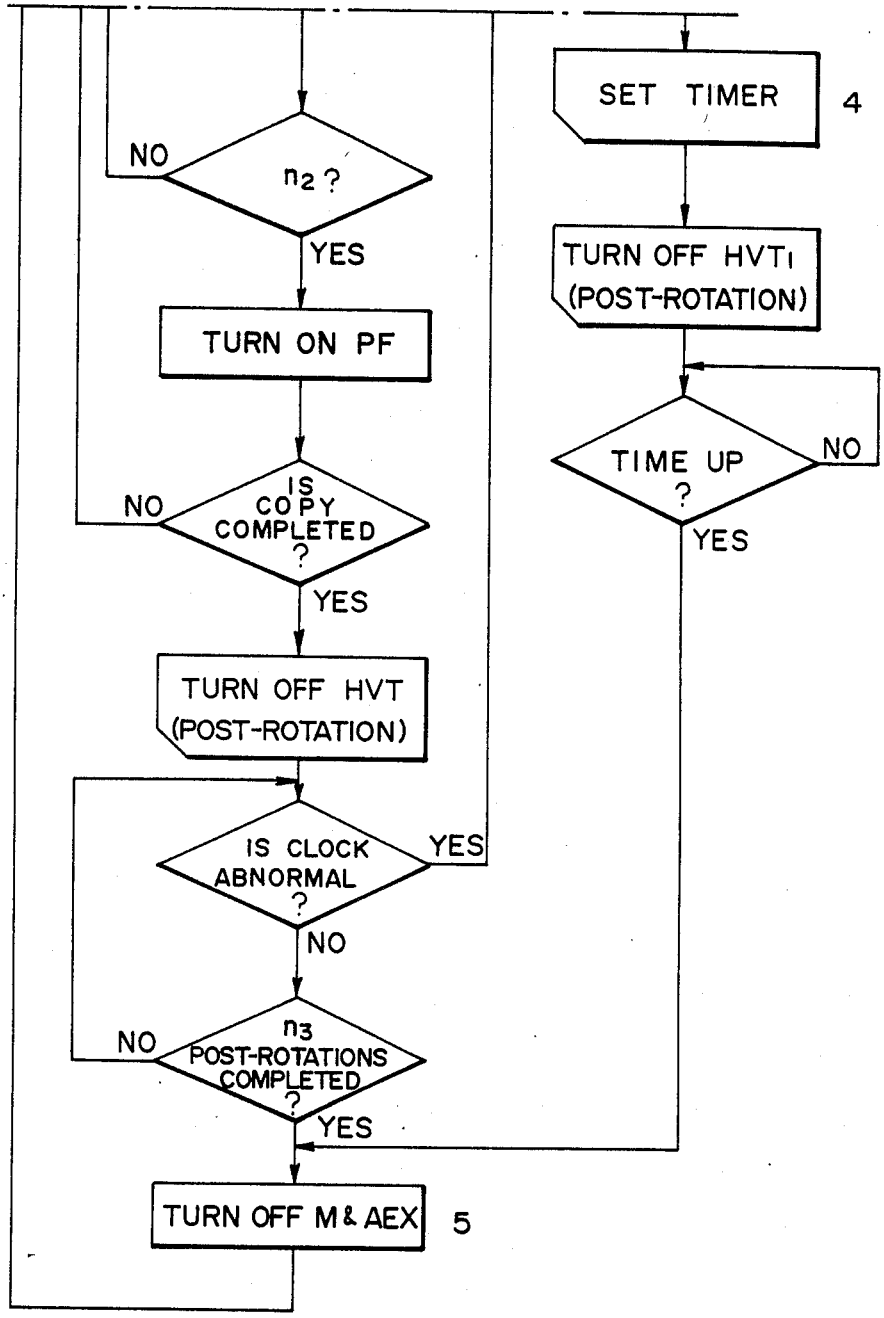

Referring to FIG. 6, when a power switch, not shown, is turned on, the microprocessor M starts the programmed operation. It first checks the input status of the copy button signal CPB at an input port $I_1$ (step 1). If the input is present, it turns on the main motor signal $M_1$, and the signals $HVT_1$, $HVT_2$ and AEX (step 2). Then, it checks if the pulse status signal PS is "1" or "0" (step 3). If it is "1", the microprocessor M sets an internal timer and brings the drum into the post-rotation step (step 4). The microprocessor M executes the program in accordance with microclock pulses or internally counts the microclock pulses or repeates a program step NOP predetermined times. During the operation of the timer, the signal $HVT_1$ is turned off to stop the charging and the signals $HVT_2$ and AEX are turned on to discharge the drum and stabilize the potential. Then, the signal $HVT_2$ is turned off while the signal AEX is kept on to stabilize the potential of the photoconductive layer by the light of the lamp. After the timer which has a time-out period of at least one revolution time of the drum for cleaning purpose has been timed out, the signals $M_1$ and AEX are turned off (step 5). In the step 4, the signal DISP is turned on to display and alarm the abnormal condition.

When the pulse status signal PS is "0", the microprocessor M counts the pulse DP through the input port $I_3$ by $n_1$ count, and when it counts up, it stop the prerotation and continues to turn on the signals IEX and FAD to enter into the latent image formation step. When the microprocessor M counts $n_2$ pulses DP, it turns on the signal PF. During the counting of $n_1$ and $n_2$, the microprocessor M checks if the signal PS is "1" or "0", and if it detects the abnormal condition it goes to the step 4 and carries out the alternative control. After the preset number of copy cycles have been repeated,- the microprocessor M enters to the post-rotation step and when it counts up $n_3$ pulses, it carries out the step 5 and stops the sequence. During this counting period, it checks the signal PS and if it is "1", the internal timer is alternatively operated to complete the post-rotation.

Since the main motor drives the feed systems 23, 24, 42, 43, 47 and 48 of the transfer paper, the paper in the course of separation can be ejected.

In FIG. 6, by turning on the signal $M_1$ after the turn-on of the copy button and turning on the signals $HVT_1$ and $HVT_2$ after the "0" status of the signal PS has been confirmed, the deterioration of the photosensitive layer by the charge during the stop of the drum when the "1" state of the signal PS is caused by the stop of the drum is prevented.

Where the pulse DP is generated by the rotation of the drum, a separate photo-interrupter which detects the movement of the feed system driven by the main motor $M_1$ may be provided so that the signal from the interrupter is compared in the step 3 or in other abnormal condition to determine it the abnormal condition of the pulse is due to the abnormal condition of the main motor or due to the failure of the pulse generators 151–155. In the former case, when the signal PS is "1", the alarm is displayed and all of the power supplies are turned off. In the latter case, the alternative control is carried out.

In the present embodiment, when the abnormal condition of the pulse is detected, the post-rotation step is initiated. Alternatively, the post-rotation step may be initiated after the preset number of copies have been made. When the post-rotation is initiated in the abnormal condition, the abnormal condition may be displayed and it may be kept displayed after the post-rotation step and the start of copy operation may be inhibited. Alternatively, the start of the copy operation may be permitted as shown in FIG. 6. In this case, however, the abnormal condition is kept displayed.

A further embodiment of the present invention is now explained.

Figure 7:
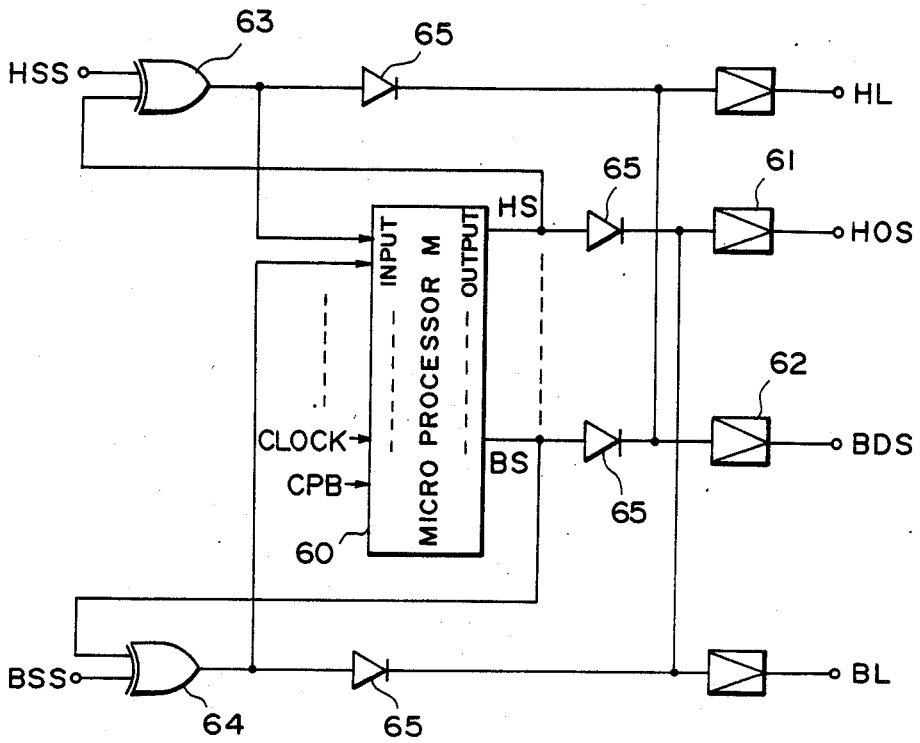
FIG. 7 shows other control circuit of the present irvention.

FIG. 7 shows a lamp fire compensation circuit. Numeral 60 denotes a microprocessor which carries out a sequence of operations by a signal CPB from a copy key and a pulse CLOCK generated as the drum rotates, numeral 61 denotes a drive amplifier which produces a signal HDS to turn on the halogen lamp 3, numeral 62 denotes a drive amplifier which produces a signal BDS to turn on the blank lamp 51 and numerals 63 and 64 denote exclusive OR gates for controlling the switching of the lamps. A signal HSS (which is "1" when the halogen lamp is on) from a halogen lamp light sensor 52 is applied to the exclusive OR gate 63 and a signal BSS (which is "1" when the blank lamp is on) from a light sensor 53 of the blank lamp is applied to the exclusive OR gate 64. The halogen lamp light sensor 52 is mounted on the first mirror and the blank lamp light sensor 53 is mounted in the vicinity of the light incident point. The signals HSS and BSS may be derived from the outputs of the drive amplifiers 61 and 62 of the respective lamps by dividing them by resistors. Numeral 65 denotes diodes for preventing interferences of signals.

Figures 1, 2, 8:
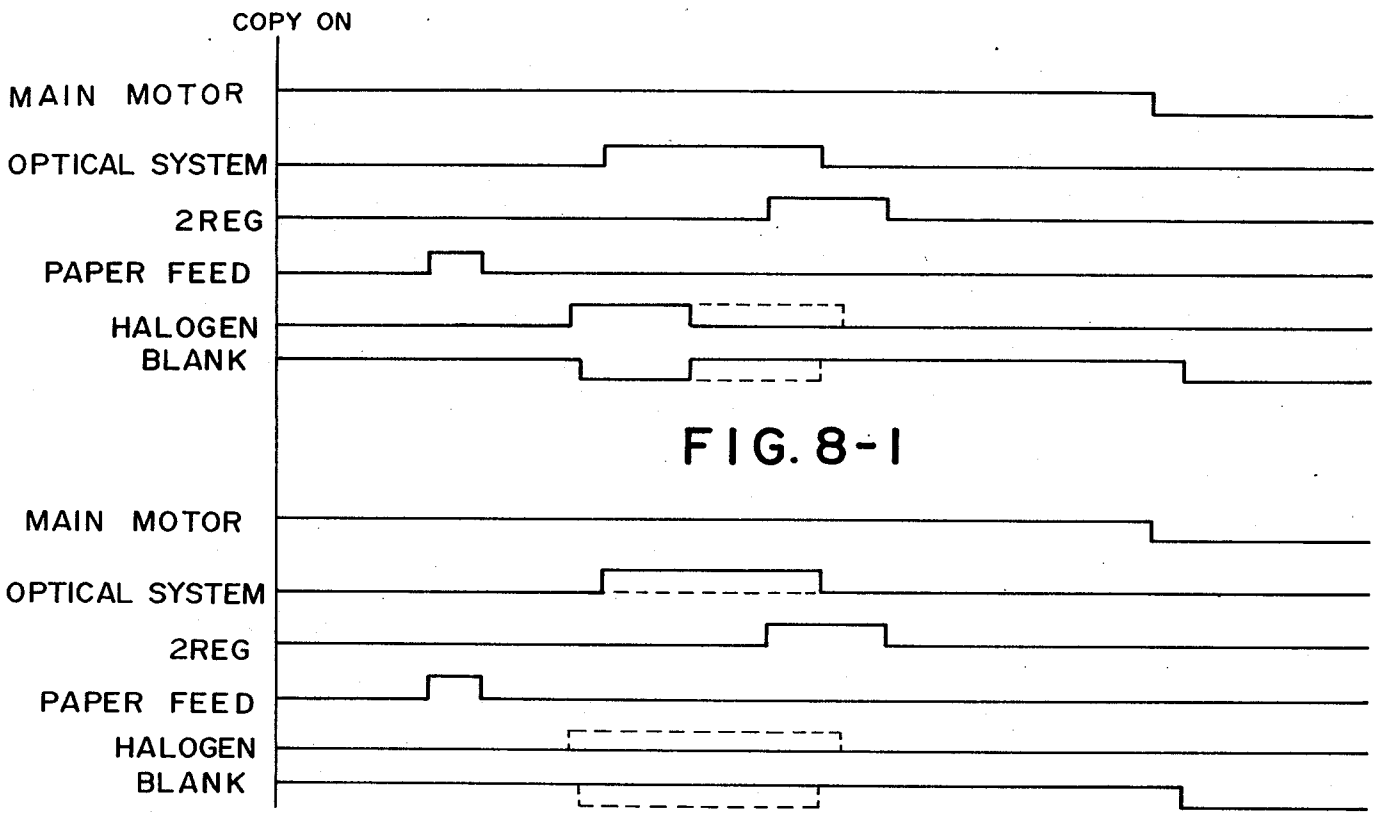
Figures 3, 8:
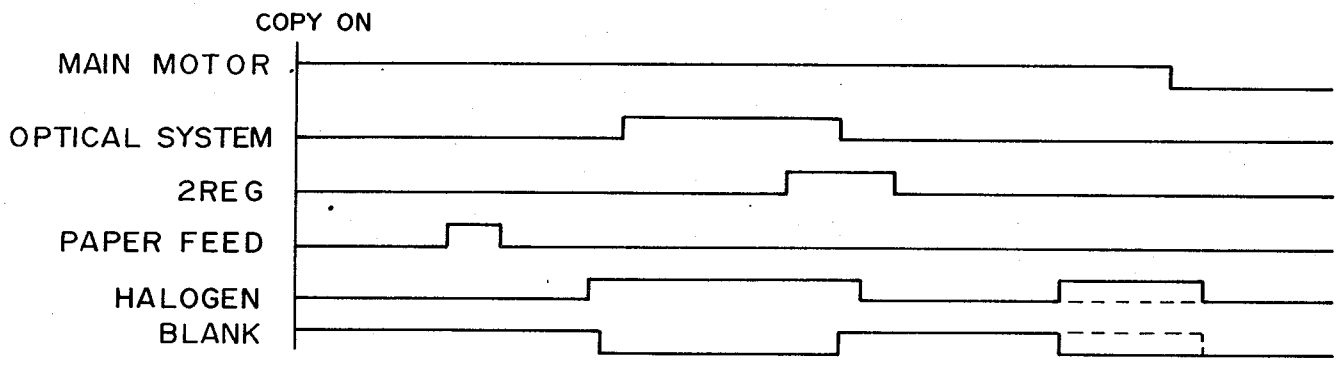
Figures 4, 8:
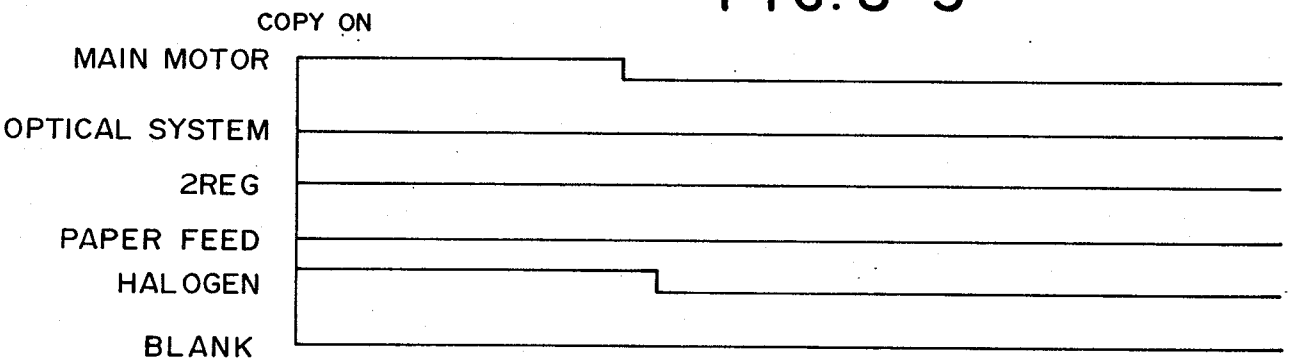

The operation of the present embodiment is now explained with reference to FIGS. 8-1 to 8-4. FIG. 8-1 illustrates an operation for turning on the blank lamp when the halogen lamp is broken during the turn-on. In FIG. 8-1, MAIN MOTOR shows a waveform of a motor which rotates the drum, OPTICAL SYSTEM shows a waveform of forward and backward movements, 2 REG shows a waveform of a rest run roll 37, PAPER FEED shows a waveform of rolls 30 and 31, and HALOGEN and BLANK show waveforms of the halogen and blank lamps. Broken lines show levels in a normal operation. If the halogen lamp is broken during its turn-on, the signal HSS changes to "0" while the turn-on signal HS from the processor is "1". As a result, the exclusive OR gate 63 produces a "1" output to forcibly turn on the blank lamp drive amplifier 62 to turn on the blank lamp.

FIG. 8-2 illustrates an operation to continuously turn on the blank lamp when the halogen lamp does not turn on at a turn-on timing. It operates in a similar manner to that of FIG. 8-1.

FIG. 8-3 illustrates an operation for turning on the halogen lamp when the blank lamp is broken during its turn-on, and FIG. 8-4 illustrates an operation for turning on the halogen lamp from the first when the blank lamp does not turn on at the turn-on timing. In any case, it is exclusively controlled by the blank lamp light sensor signal BSS and the blank lamp turn-on signal BS.

In FIGS. 8-1 to 8-4, if an abnormal condition occurs, the drum and the lamps are deactivated after a predetermined time period.

By providing the above circuit between the black suppression lamp 51' and the halogen lamp 3 or between the black suppression lamp 51' and the blank lamp 51, or among those three lamps, all of the black suppression lamps 51' are turned on when one or both of the halogen lamp and the blank lamp are broken to attain the same effect.

Display lamp HL or BL is turned on in response to the outputs of the exclusive OR gates 63 and 64 to alarm the break of one of the lamps. When both lamps HL and BL are turned on, it indicates that both lamps are broken.

We claim:

1. An image forming apparatus comprising:

a plurality of processing means for forming an image on a recording medium;

means for generating serial pulses for controlling at least one of said processing means, wherein the generating means generates the serial pulses in association with operation of said recording medium; and control means having a memory which stores a predetermined program therein, for controlling said plurality of processing means and performing image formation in accordance with said predetermined program, said control means having detecting means for detecting a condition of said pulses before the initial operation of said processing means is started after a start of operation of said recording medium, wherein said detecting means performs its said detecting operation after entry of an instruction for image formation; and wherein said control means supplies a starting signal to the processing means after a normal condition of said serial pulses is detected, generates a signal representative of an abnormality, and prevents a start of the operation of said processing means, when an abnormal condition of said serial pulses is detected.

2. An image forming apparatus comprising:

a plurality of processing means for forming an image on a recording medium;

means for generating a series of pulses;

control means for counting said pulses to control at least one of said processing means;

means for detecting a condition of said pulses generated by said generating means; and means for starting a separate timer to carry out a predetermined operation mode for a predetermined period of time without using said pulses when an abnormal condition of said pulses is detected by said detecting means.

3. An image forming apparatus comprising:

a plurality of processing means for image formation on a recording medium, said processing means including a first discharging means and a second discharging means each adapted to remove charges on said recording medium;

detecting means for detecting an abnormal condition of said first discharging means or said second discharging means; and control means for controlling said first discharging means and said second discharging means so as to activate one of said first and second discharging means when an abnormal condition of the other of said second and first discharging means is detected by said detecting means upon start of an operation of said second or first discharging means or during the operation of said second or first discharging means.

4. An image forming apparatus according to claim 3 wherein said discharging means is light illumination means, and when the light illumination means in the abnormal condition is image exposing means, the light illumination means operated is blank exposure means, said blank exposure means being turned on when said image exposure means is not turned on by a turn-on instruction or said image exposure means is turned off during its image exposure operation.

5. An image forming apparatus according to claim 3 wherein when the light illumination means in the abnormal condition is blank exposure means, the light illumination means operated is image exposure means, said image exposure means being turned on when said blank exposure means is not turned on by a turn-on instruction or said blank exposure means is turned off during its blank exposure operation.

6. An image forming apparatus according to claim 4 or 5 wherein an alarm is displayed when said image exposure means or said blank exposure means is abnormal.

7. An image forming apparatus according to claim 4 or 5 wherein further light illumination means or discharge corona means is operated when both said image exposure means and said blank exposure means are abnormal.

8. An image forming apparatus according to claim 2, wherein said starting means carries out said predetermined operation mode for uniformly cleaning said recording medium or uniformly stabilizing a potential of said recording medium and then stopping said recording medium.

9. An image forming apparatus according to claim 1, wherein said processing means includes means for charging and discharging said recording medium, and wherein said control means starts the operation of said charging means and/or said discharging means after a normal condition of said pulses has been confirmed by said detecting means, and prevents a start of the operation of said charging means and/or discharging means, when an abnormal condition of said pulses is detected by said detecting means.

10. An image forming apparatus according to claim 1, wherein said detecting means detects an abnormal condition of said pulses when said pulse is not generated in a predetermined time period.

11. An image forming apparatus according to claim 2, wherein said generating means generates said serial pulses ink association with an operation of said recording medium.

12. An image forming apparatus according to claim 11, wherein said detecting means detects a condition of the pulses generated by said pulse generating means before the first operation of said processing means is initiated after a start of operation of said recording medium, and wherein said control means supplies a starting signal to the processing means after a normal condition of said serial pulses is detected, and includes means for generating a signal representative of an abnormality, and for preventing a start of the operation of said processing means, when an abnormal condition of said serial pulses is detected before the first operation of said processing means is initiated.

* * * * *

UNITED STATES PATENT AND TRADEMARK OFFICE

CERTIFICATE OF CORRECTION

PATENT NO. : 4,669,862

DATED : June 2, 1987

INVENTOR(S) : Toshiaki Yagasaki; Shunichi Masuda; Yukio Sato

It is certified that error appears in the above-identified patent and that said Letters Patent is hereby corrected as shown below:

Col. 1, line 43, "non-disrimi-" should read -- non-discrimi --

Col. 2, line 10, "other" should read -- another --

Col. 2, line 11, "apparatus allows" should read -- apparatus which allows --

Col. 2, line 26, "detccted," should read -- detected, --

Col. 2, line 38, "other" should read -- another --

Col. 2, line 58, "feature" should read -- future --

Col. 3, line 14, "flow of" should read -- flow chart of --

Col. 3, line 15, "other" should read -- another --

Col. 3, line 36, "mounted" should read -- mount --

Col. 4, line 45, "repeates" should read -- repeats --

UNITED STATES PATENT AND TRADEMARK OFFICE

CERTIFICATE OF CORRECTION

PATENT NO. : 4,669,862

DATED : June 2, 1987

INVENTOR(S) : Toshiaki Yagasaki; Shunichi Masuda; Yukio Sato

It is certified that error appears in the above-identified patent and that said Letters Patent is hereby corrected as shown below:

Col. 5, line 19, "thc" should read -- the --

Col. 7, line 1, "repeates" should read -- repeats --

Col. 7, line 16, "stop" should read -- stops --

Col. 7, line 45, "it" should read -- if --

Col. 8, line 17, "denotcs" should read -- denotes --

Col. 10, line 42 "ink" should read -- in --.

Signed and Sealed this

Twenty-seventh Day of October, 1987

*Attest:*

DONALD J. QUIGG

*Attesting Officer*

*Commissioner of Patents and Trademarks*